US007637500B2

(12) United States Patent
Schalk et al.

(10) Patent No.: US 7,637,500 B2
(45) Date of Patent: Dec. 29, 2009

(54) ADVANCING A MEDIA SHEET ALONG A MEDIA PATH

(75) Inventors: Wesley R. Schalk, Vancouver, WA (US); Allan G. Olson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 400 days.

(21) Appl. No.: 11/391,111

(22) Filed: Mar. 28, 2006

(65) Prior Publication Data

US 2007/0235921 A1 Oct. 11, 2007

(51) Int. Cl.
*B65H 9/04* (2006.01)

(52) U.S. Cl. ..... 271/242

(58) Field of Classification Search ..... 271/242, 271/243, 244, 245, 246, 253, 254, 255
See application file for complete search history.

(56) References Cited

U.S. PATENT DOCUMENTS

| | | | | |
|---|---|---|---|---|
| 5,152,622 | A | 10/1992 | Rasmussen et al. | |
| 5,316,285 | A | 5/1994 | Olson et al. | |
| 5,595,380 | A | 1/1997 | McCue, Jr. et al. | |
| 5,662,321 | A | 9/1997 | Borostyan et al. | |
| 5,673,909 | A | 10/1997 | Delorme et al. | |
| 5,904,350 | A * | 5/1999 | Creighton et al. | 271/227 |
| 5,933,697 | A * | 8/1999 | Onodera et al. | 399/406 |
| 6,105,957 | A | 8/2000 | Miller et al. | |
| 6,135,447 | A | 10/2000 | Lin | |
| 6,533,265 | B1 | 3/2003 | Baldini | |
| 6,749,192 | B2 | 6/2004 | Olson et al. | |
| 6,805,347 | B2 | 10/2004 | Kuramoto | |
| 6,805,508 | B2 | 10/2004 | Castleberry | |
| 6,834,853 | B2 | 12/2004 | Trovinger et al. | |
| 6,951,429 | B2 | 10/2005 | Aoyama | |
| 6,974,128 | B2 | 12/2005 | Quesnel | |
| 6,988,725 | B2 | 1/2006 | Rapkin | |
| 7,007,941 | B2 * | 3/2006 | Youn | 271/10.11 |
| 7,380,789 | B2 * | 6/2008 | Murrell et al. | 271/270 |
| 2003/0095722 | A1 | 5/2003 | Regimbal | |
| 2003/0122297 | A1 * | 7/2003 | Youn | 271/10.01 |
| 2005/0067768 | A1 | 3/2005 | Conner et al. | |
| 2005/0263958 | A1 | 12/2005 | Knierim et al. | |
| 2005/0286956 | A1 | 12/2005 | Braun et al. | |
| 2006/0012104 | A1 | 1/2006 | Kim | |

FOREIGN PATENT DOCUMENTS

| | | | |
|---|---|---|---|
| EP | 0 854 106 | A2 | 7/1998 |
| EP | 1 369 367 | A2 | 12/2003 |
| JP | 2001106390 | A | 4/2001 |
| JP | 2004359392 | A | 12/2004 |

* cited by examiner

*Primary Examiner*—Patrick H Mackey
*Assistant Examiner*—Thomas A Morrison
(74) *Attorney, Agent, or Firm*—Jack H. McKinney

(57) ABSTRACT

Embodiments of a method and apparatus for advancing a media sheet are shown and described in which a media sheet is urged along a media path toward a first position and a second position. The second position is downstream from the first position along the media path. As a leading edge of the media sheet reaches the first position, the leading edge is prevented from passing the first position for an initial time period while the media sheet is being urged along the media path. As the leading edge reaches the second position, the leading edge is prevented from passing the second position for a subsequent time period while the media sheet is being urged along the media path.

17 Claims, 9 Drawing Sheets

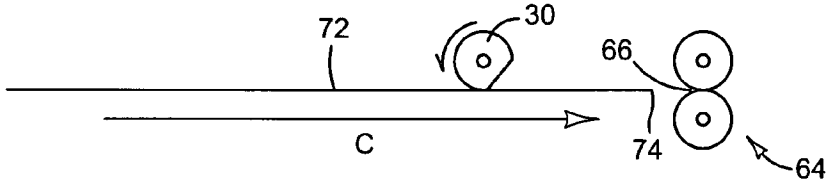
FIG. 7A
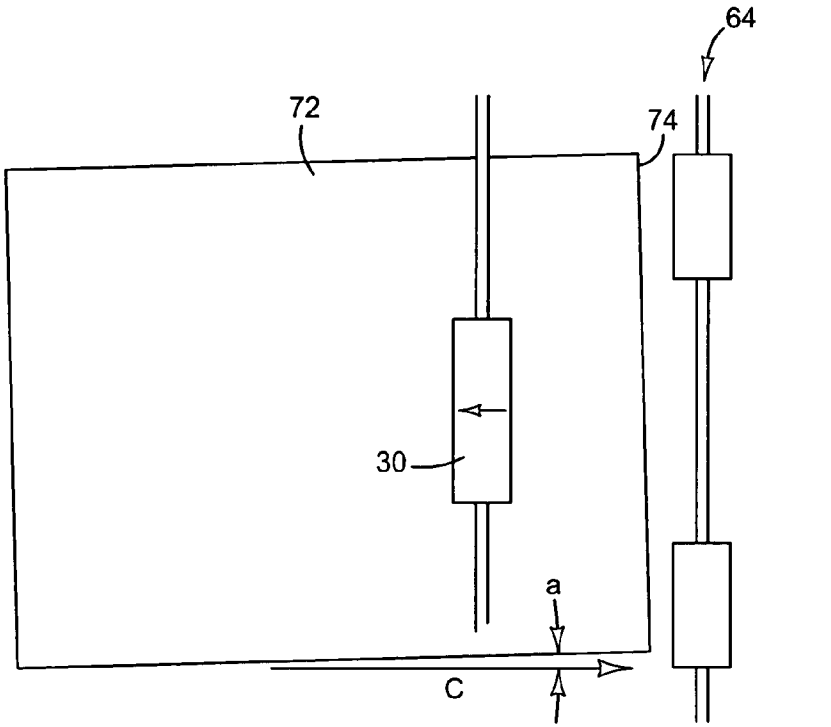
FIG. 7B
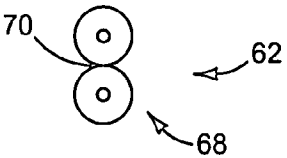
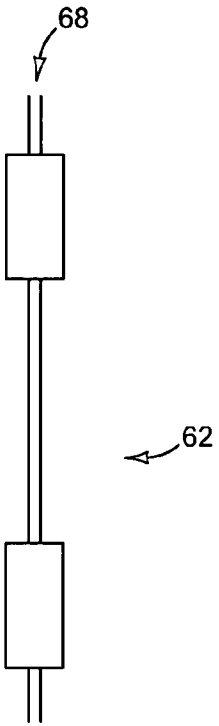

ADVANCING A MEDIA SHEET ALONG A MEDIA PATH

BACKGROUND

Media handling systems can benefit from reducing skew, where "skew" is defined as the misalignment of a print media sheet media as a leading edge approaches or reaches a position in which media orientation affects the operation of the system. Skew, for example, can result in the media sheet becoming jammed or stuck within a media path of an image forming device. Skew can also cause misaligned formation of images on the media sheet. Conventional approaches to addressing skew have, in some applications, not adequately reduced skew, been cumbersome, or both.

DRAWINGS

FIGS. 7A/7B-11A/11B are a series of sequential schematic diagrams illustrating an exemplary implementation of an embodiment.

DETAILED DESCRIPTION

INTRODUCTION: Various embodiments provide for multi-stage skew correction. Instead of routing and rerouting media sheets through a single de-skew mechanism, embodiments operate to route media sheets through multiple de-skew mechanisms as those sheets are passed from an origin to a destination. As an example, in a printer or copier implementation, a media sheet is picked from an input tray, routed trough an initial de-skew mechanism and then routed though one or more subsequent de-skew mechanisms before being passed to a print engine where an image is formed on the media sheet.

Although the various embodiments disclosed herein will be described with reference to an image forming device such as a printer or copier, other embodiments are also envisioned. Embodiments may be implemented in any environment in which it is desirable to transport or otherwise move media sheets from one position to another along a media path. Printers and copiers simply provide a useful example in which media sheets are picked from an input tray, fed along a media path to a print zone, and then discharged into an output bin.

Figure 1:
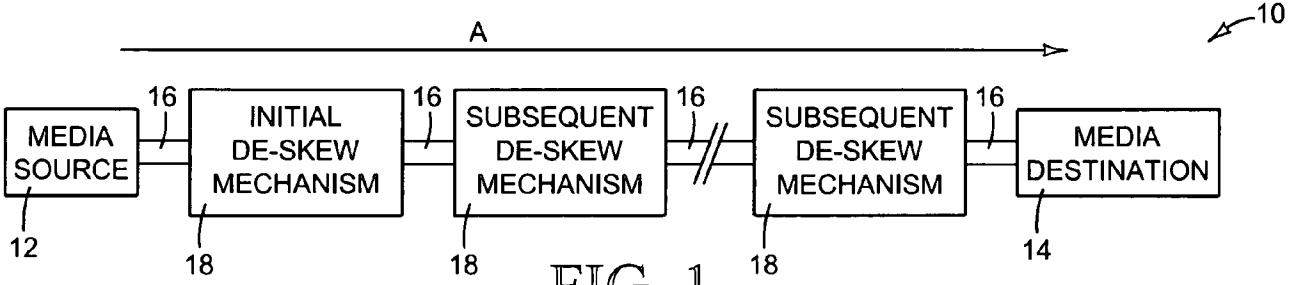
FIG. 1 is an exemplary block diagram of a multi-stage skew correction system according to an embodiment.

Referring to FIG. 1, handling system 10 is shown to include media source 12, media destination 14, media path 16, and de-skew mechanisms 18. Media source 12 represents generally any source of media sheets upstream of de-skew mechanisms 18 along media path 16. Media destination 14 represents generally any position downstream of de-skew mechanisms 18 along media path 16. Where system 10 is implemented in a printer, copier, or other image forming device, media source 12 may, for example, be an input tray capable of holding a stack of media sheets, and media destination 14 may be a print zone where images are formed on the media sheet. Media path 16 represents generally any path along which a media sheet can be urged in direction (A) from media source 12 to media destination 14. The media path 16 may be straight or curved.

De-skew mechanisms 18, examples of which are discussed in more detail below, represent generally any combination of hardware components capable of reducing skew in a media sheet. De-skew mechanisms 18 are positioned along media path 16 to act on a media sheet as it travels along media path 16. While FIG. 1 is intended to illustrate a system 10 having three or more de-skew mechanisms, system 10 could include two de-skew mechanisms 18. Furthermore, system 10 may include one or more additional components (not shown) positioned anywhere along media path 16.

Figure 2:
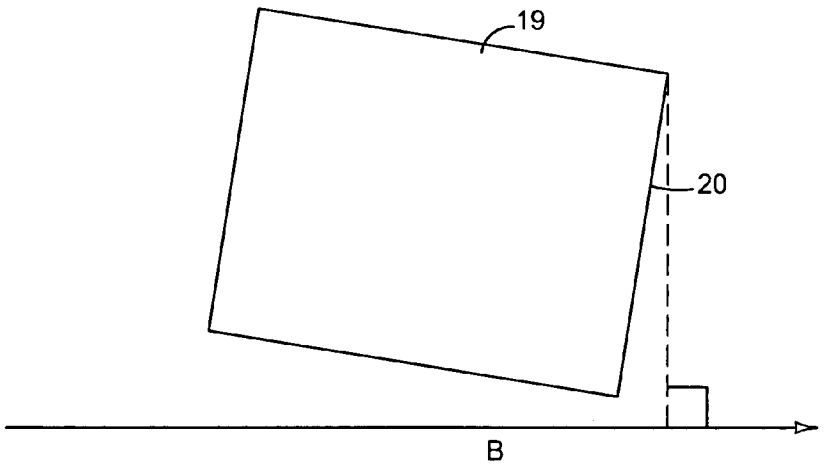
FIG. 2 illustrates an example of a skewed media sheet.

FIG. 2 illustrates media sheet 19 positioned in a media path traveling in direction (B). As positioned, media sheet 19 is skewed relative to direction (B). In other words, the leading edge 20 of media sheet 19 is not perpendicular with respect to direction (B) deviating by an angle referred to as the skew angle or simply the skew. Referring back to FIG. 1, as a media sheet is urged along media path 16 in direction (A), each de-skew mechanism 18 may act on the media sheet to reduce or correct any skew. As any one de-skew mechanism 18 may not be entirely successful at correcting skew, a subsequent de-skew mechanism along media path 16 may help to reduce any residual skew to a more acceptable level.

Figure 3A:
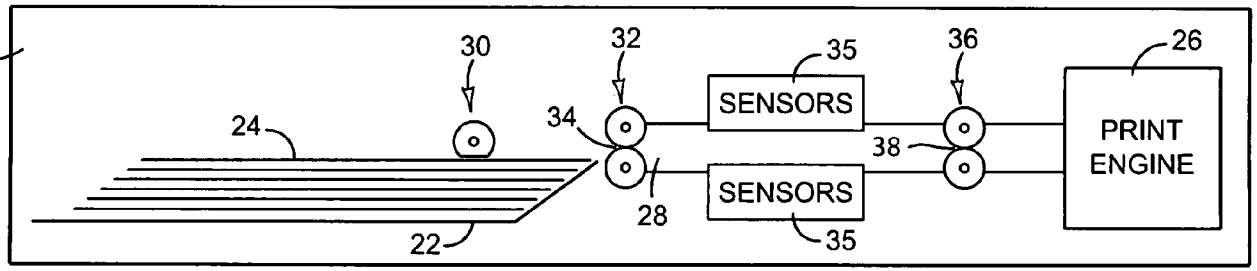
FIGS. 3A and 3B are schematic diagrams of an exemplary multi-stage skew correction system incorporated in an image forming device according to an embodiment.
Figure 3B:
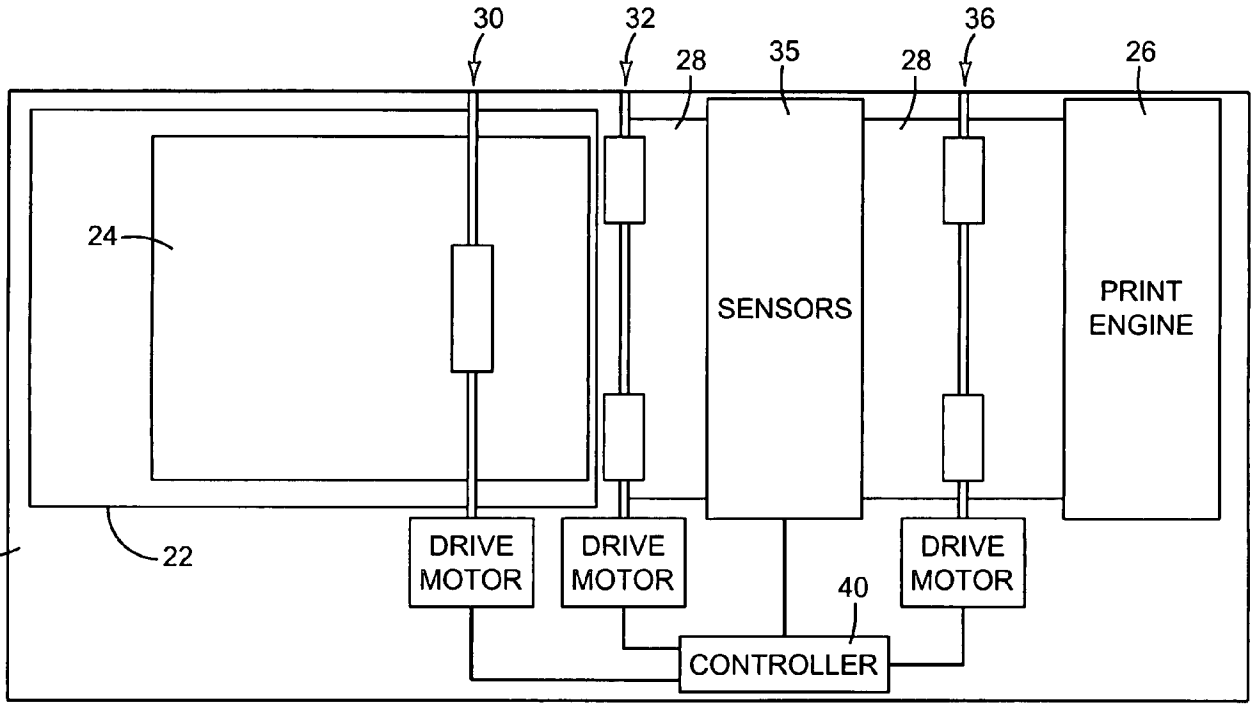

COMPONENTS: The physical and logical components of various embodiments will now be described with reference to the exemplary diagrams of FIGS. 3A and 3B. FIG. 3A is a side view of an image forming device 21 capable of multi-stage skew correction. FIG. 3B is a top view. For efficiency, some components visible in FIG. 3B are not shown in FIG. 3A.

Image forming device 21 includes media input tray 22, media sheets 24 and print engine 26. Media path 28 extends between input tray 22 and print engine 26. Print engine 26 represents generally any combination of hardware and programming capable of forming images on media sheets 24 being urged along media path 28. In some embodiments, the print engine may be an inkjet print engine. In other embodiments, the print engine may be an electro-photographic print engine.

Image forming device 21 also includes pick mechanism 30, initial de-skew mechanism 32, initial nip 34, subsequent de-skew mechanism 36, and subsequent nip 38 and controller 40. Pick mechanism 30, shown to include a pick roller operated via a drive motor and is responsible for sequentially urging media sheets 24 along media path 28 toward initial de-skew mechanism 32. Initial de-skew mechanism 32 is shown to include a pair of de-skew rollers operated by a drive motor. Initial de-skew rollers define initial nip 34 located generally at a first position along media path 28 that is downstream from pick mechanism 30. Initial nip 34 is the region where the surfaces of the initial de-skew rollers meet or are closest together. This region is shaped to receive a leading edge of the media sheet 24. Rotation of the initial de-skew rollers allows initial nip 34 to grip the leading edge and pull the media sheet 24 along media path 28.

Initial nip 34 defines a line that is generally perpendicular to the direction of travel of the media sheet 24 along media path 28. Consequently, skew can be reduced by causing the leading edge of the media sheet 24 to contact initial nip 34 before rotating the initial de-skew rollers forward to pull the media sheet along media path 28. In some embodiments, therefore, causing the leading edge of the media sheet 24 to contact initial nip 34 while media sheet 24 is driven downstream and the rollers are not rolling forward may help reduce skew in media sheet 24 by increasing alignment between the leading edge of the sheet with initial nip 34.

Subsequent de-skew mechanism 36 is shown to include a subsequent pair of de-skew rollers operated by a drive motor. The subsequent pair of de-skew rollers define subsequent nip 38 located at a second position along media path 28 that is downstream from the first position. Subsequent de-skew mechanism 36 may also include one or more sensors positioned downstream along media path 28 from the initial de-skew rollers. As illustrated in FIGS. 3A and 3B, separate, dedicated drive motors are used to operate the pick mechanism and the initial and subsequent de-skew rollers. Alternatively, a common drive motor may be used to drive both the pick mechanism and the initial and subsequent de-skew rollers or any sub combination thereof.

The sensors, if provided by subsequent de-skew mechanism 36, are for use in detecting residual skew in a media sheet 24 being urged along media path 28. Residual skew is any skew remaining after the media sheet 24 passes initial de-skew mechanism 32 along media path 28. The sensors may, for example, include a light source and one or more photo receptive cells positioned across a width of media path 28 where each cell is capable of generating a signal representative of whether or not a media sheet 24 is positioned between that cell and the light source. In this manner, if a cell or group of cells on one side of the media path detects the presence of a media sheet 24 and the cells on the other side of the media path 28 do not, it can presumed that the media sheet 24 being urged along media path 28 has some residual skew.

Subsequent nip 38 is the region where the surfaces of the subsequent de-skew rollers meet or are closest together. This region is shaped to receive a leading edge of the media sheet. Rotation of the subsequent de-skew rollers allows subsequent nip 38 to grip the leading edge and pull the media sheet 24 along media path 28. Subsequent nip 38 defines a line that is generally perpendicular to the direction of travel of the media sheet 24 along media path 28. Consequently, any residual skew not corrected by the initial de-skew mechanism 32 can be reduced by causing the leading edge of media sheet 24 to contact the subsequent nip 38 before rotating the subsequent de-skew rollers forward to pull the media sheet along media path 28 toward print engine 26.

Subsequent nip 38 defines a line that is generally perpendicular to the direction of travel of the media sheet 24 along media path 28. Consequently, skew can be reduced by causing the leading edge of media sheet 24 to contact subsequent nip 38 before rotating the subsequent de-skew rollers forward to pull media sheet 24 along media path 28. In some embodiments, therefore, causing the leading edge of media sheet 24 to contact subsequent nip 38 while the sheet 24 is driven downstream and the rollers are not rolling forward may help reduce any residual skew in media sheet 24 by increasing alignment between the leading edge of the media sheet with subsequent nip 38.

Controller 40 represents generally any combination of hardware and programming capable of guiding the operation of pick mechanism 30, initial de-skew mechanism 32 and subsequent de-skew mechanism 36. For example, controller 40 may be a microprocessor executing program instructions for selectively controlling those components. In performing its tasks, controller 40 causes pick mechanism 30 to urge a media sheet 24 toward initial de-skew mechanism 32 at a first position along media path 28. Controller 40 causes the initial de-skew rollers of initial de-skew mechanism 32 to oppose the continued motion of the leading edge of the media sheet 24 passed the first position for an initial time period. This allows the leading edge to more fully engage the initial nip 34 as the pick mechanism 30 continues to urge the media sheet downstream along media path 28.

Following the initial time period, controller 40 causes the initial de-skew mechanism to rotate the initial de-skew rollers to grip and urge the media sheet 24 further downstream along the media path 28 toward subsequent de-skew mechanism 36 at a second position along media path 28. Controller 40 communicates with the sensors of subsequent de-skew mechanism 36 to determine if the media sheet 24 has a residual skew. If so and if the residual skew is sufficiently large, controller 40 causes the subsequent de-skew rollers of subsequent de-skew mechanism 36 to oppose the continued motion of the leading edge of the media sheet 24 passed the second position for a subsequent time period allowing the leading edge of media sheet 24 to more fully engage the subsequent nip 38 as the initial de-skew mechanism 32 continues to urge the media sheet along media path 28.

Following the subsequent time period, controller 40 causes the subsequent de-skew mechanism to rotate the subsequent de-skew rollers to grip and urge the media sheet 24 further along the media path 28 toward print engine 26. Where controller 40 does not identify a residual skew or where the detected residual skew is determined insignificant, controller 40 causes the subsequent de-skew mechanism 36 to not oppose the media sheet 24 but to urge the media sheet 24 along media path 28 passed the second position and toward print engine 26.

It is noted that the terms initial and subsequent are used herein simply to distinguish relative positions of various components along a media path and relative positions of time periods along a time line.

Figure 4:
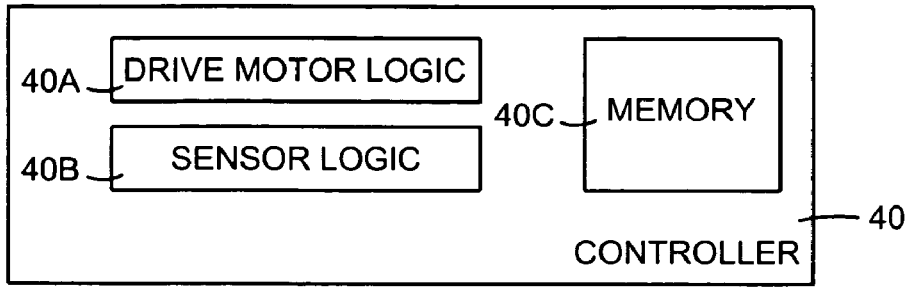
FIG. 4 is an exemplary block diagram illustrating logical components for use in implementing various embodiments.

FIG. 4 provides an example of the logical components of controller 40. Here, controller 40 is shown to include drive motor logic 40A, sensor logic 40B, and memory 40C. Memory 40C represents generally any readable memory capable of storing data regarding the initial and subsequent time periods for which initial and subsequent de-skew mechanisms 32 and 36 are caused to oppose a media sheet 24 from continuing along media path 28. Memory 40 may also store media sheet dimensions and a threshold value to be compared against an identified residual skew.

Drive motor logic 40A represents any combination of hardware and/or programming capable of selectively controlling the drive motors of pick mechanism 30, initial de-skew mechanism 32, and subsequent de-skew mechanism 36. Drive motor logic 40A causes pick mechanism 30 to urge a media sheet 24 toward initial de-skew mechanism 32 while causing initial de-skew mechanism 32 to prevent the leading edge of the media sheet 24 from passing through initial nip 34 for the initial time period as pick mechanism 30 continues to urge the media sheet 24 downstream along media path 28. This allows the leading edge to more fully engage initial nip 34 helping to correct any skew. Following the initial time period, drive motor logic 40A causes initial de-skew mechanism 32 to cooperate with pick mechanism 30 and urge the media sheet along media path 28 toward subsequent de-skew mechanism 36.

Sensor logic 40B represents generally any combination of hardware and/or programming capable of communicating with the sensors of subsequent de-skew mechanism 36 to identify any residual skew in a media sheet 24 and the magnitude of that skew. For example, sensor logic 40B can use the sensors to determine a difference in time between when one leading edge corner or other portion of the media sheet 24 and another leading edge corner or other portion of the media sheet pass a given position along media path 28. With that time difference and the dimensions of the media sheet 24 obtained from memory 40C, sensor logic 40B can calculate an angle, if any, for the residual skew.

Sensor logic 40B compares that angle to the threshold value in memory 40C. If the angle exceeds the threshold value, then sensor logic 40B instructs drive motor logic 40A to cause subsequent de-skew mechanism 36 to prevent the leading edge of the media sheet 24 from passing through subsequent nip 38 for the subsequent time period as initial de-skew mechanism 32 continues to urge the media sheet 24 along media path 28. This allows the leading edge to more fully engage subsequent nip 38 helping to correct the residual skew. Following the subsequent time period or when the angle of the residual skew does not exceed the threshold value from memory 40C, drive motor logic 40A causes subsequent de-skew mechanism to cooperate with initial de-skew mechanism 32 and further urge the media sheet along media path 28 toward print engine 26.

Figure 5:
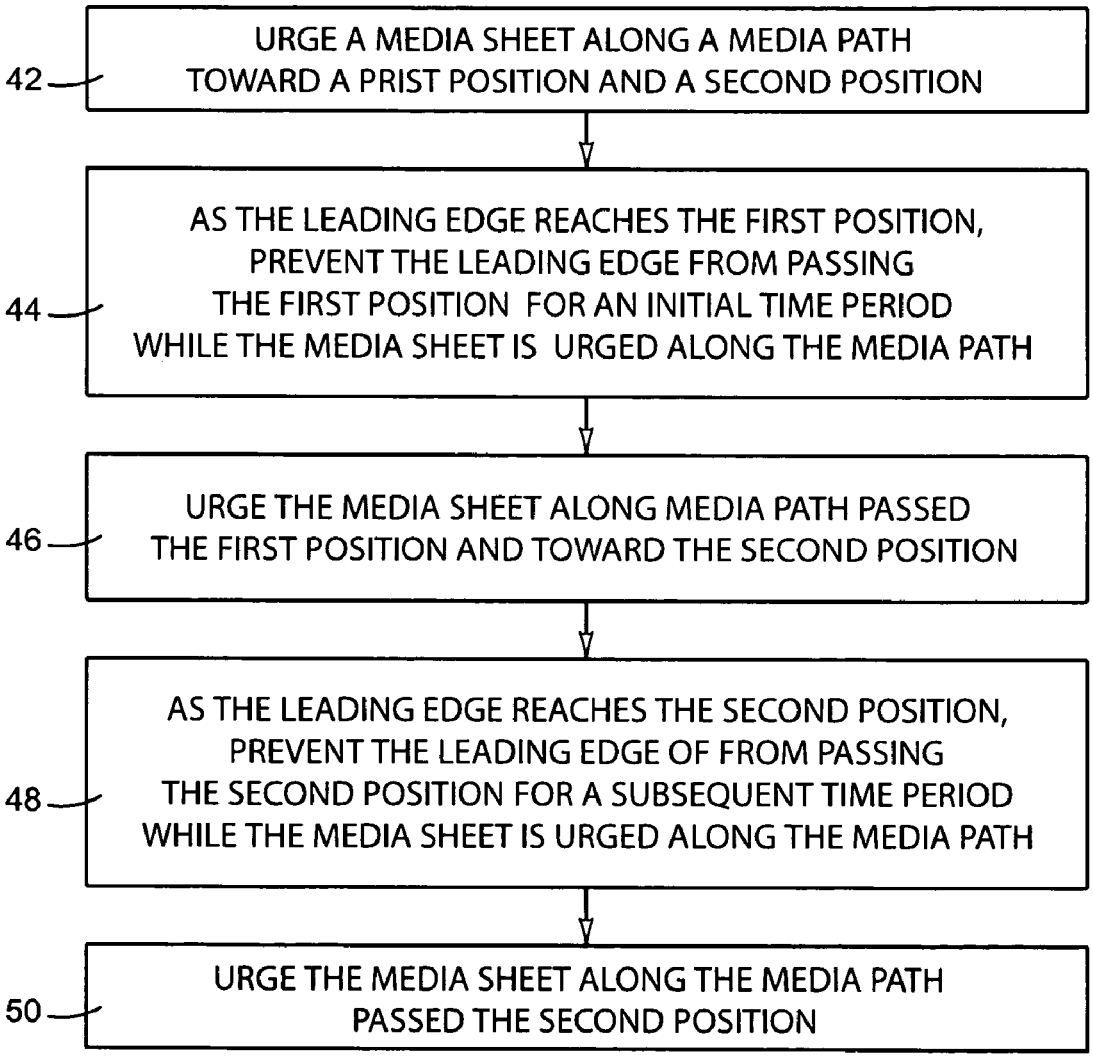
FIGS. 5 and 6 are exemplary flow diagrams of steps taken to implement various embodiments.
Figure 6:
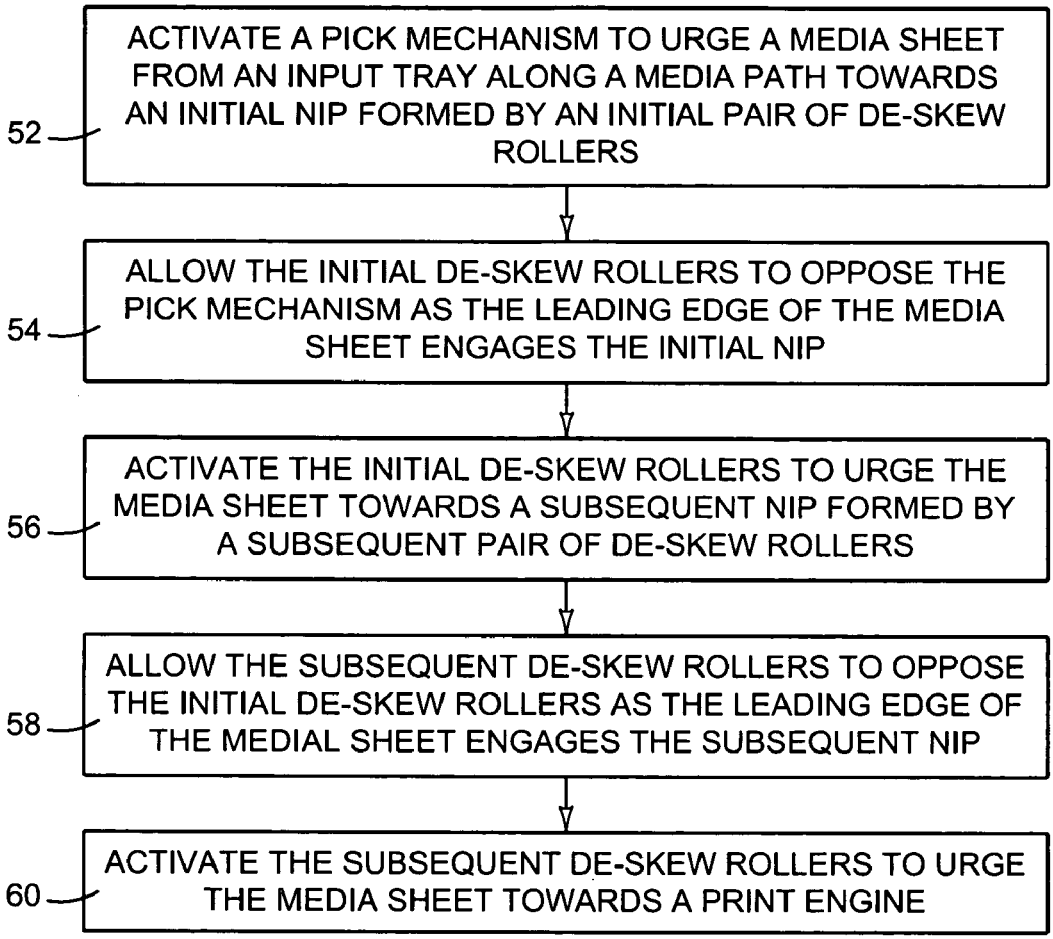

OPERATION: The operation of embodiments will now be described with reference to the flow diagrams of FIGS. 5 and 6. FIGS. 5 and 6 illustrate exemplary flow diagrams of steps taken to implement particular embodiments.

Starting with FIG. 5, a media sheet is urged along a media path toward a first position and a second position (step 42). The second position is downstream from the first position along the media path. Referring back to FIGS. 3A and 3B, for example, the first position may be the position of the initial de-skew rollers and the second position may be the position of the subsequent de-skew rollers. As the leading edge of the media sheet reaches the first position, the leading edge is prevented from passing the first position for an initial time period while the media sheet is urged along the media path (step 44). Following the initial time period, the media sheet is urged along the media path passed the first position and toward the second position (step 46).

As the leading edge of the media sheet reaches the second position, the leading edge is prevented from passing the second position for a subsequent time period while the media sheet is urged along the media path (step 48). In one embodiment, step 48 may be performed in response to detection or determination of a residual skew angle at or above a threshold value and otherwise skipped. Alternatively, step 48 may be performed without detection of the residual skew angle. Following the subsequent time period, the media sheet is urged passed the subsequent de-skew mechanism along the media path (step 50).

In an alternate exemplary embodiment of FIG. 6, a pick mechanism is activated to urge a media sheet from an input tray along a media path toward an initial nip formed by an initial pair of de-skew rollers at a first position along a media path (step 52). The initial de-skew rollers are allowed or otherwise caused to oppose the pick mechanism as the leading edge of the media sheet engages the initial nip (step 54). The initial de-skew rollers are then activated to urge the media sheet toward a subsequent nip formed by a subsequent pair of de-skew rollers at a second position along the media path (step 56).

The subsequent de-skew rollers are allowed or otherwise caused to oppose the initial de-skew rollers as the leading edge of the media sheet engages the subsequent nip (step 58). In one embodiment, step 58 may be performed after a residual skew angle is detected or determined to exceed a threshold value and otherwise skipped. Alternatively, step 58 may be performed without detection of the residual skew angle. The subsequent de-skew rollers are then activated to urge the media sheet toward a print engine (step 60).

Steps 54 and 58 may, for example be accomplished by affecting a rotation of the respective de-skew rollers. For example, the respective de-skew rollers could be rotated in directions opposing the direction of travel of the media sheet. Alternatively, the respective de-skew rollers may be stopped or held stationary preventing the media sheet from passing through the respective nips. Alternatively, the respective de-skew rollers may urge the media sheet through the nip a particular distance and then rotate in directions opposing the direction of travel of the media sheet until the leading edge of the media more fully engages the nip. Alternatively, the respective de-skew rollers may rotate at a velocity slower than the pick mechanism and/or the initial de-skew rollers to allow the leading edge of the media to more fully engage the nip.

Examples

FIGS. 7A/7B-11A/11B illustrate an exemplary implementation in which a media sheet is passed through system capable of multi-stage skew correction. FIGS. 7A, 8A, 9A, 10A, and 11A illustrate side views of an exemplary multi-stage skew correction system 62 at different points in time. FIGS. 7B, 8B, 9B, 10B, and 11B illustrate top views of system 62 at corresponding points in time.

Starting with FIGS. 7A and 7B, multi-stage skew correction system 62 includes an initial pair of de-skew rollers 64 defining an initial nip 66 and a subsequent pair of de-skew rollers 68 that define subsequent nip 70. A media sheet 72 is being urged in direction (C) toward the initial de-skew rollers 64 such that leading edge 74 will eventually engage initial nip 66. Angle (a) represents the skew of media sheet 72. The initial de-skew rollers 62 are stationary.

Figure 8A:
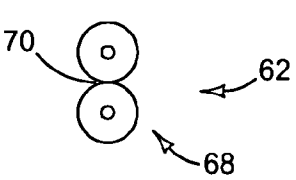
Figure 8A:
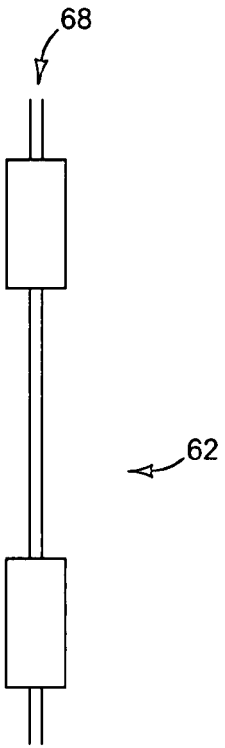
Figure 8A:
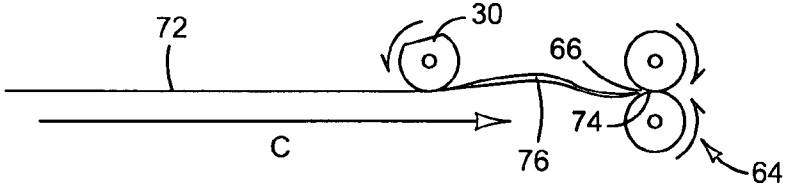
Figure 8B:
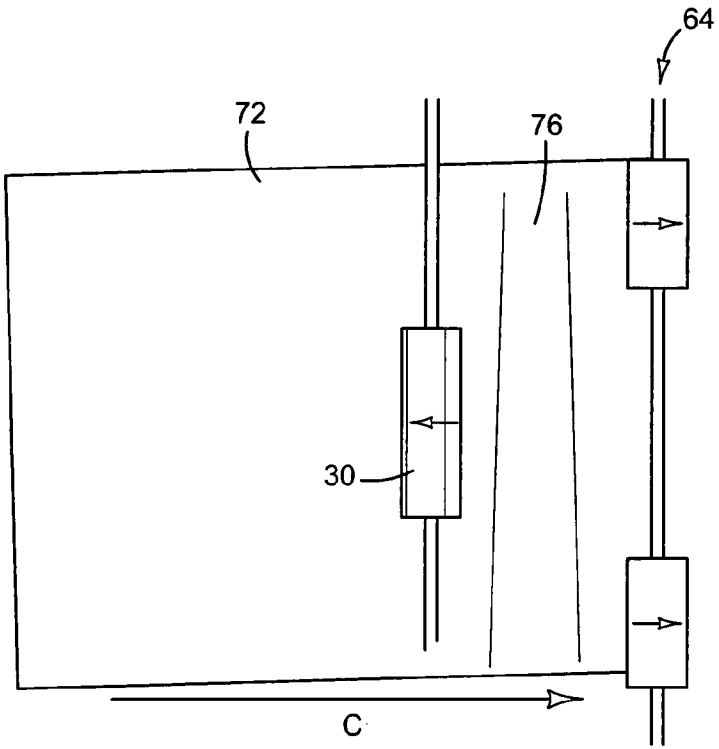

Moving on to FIGS. 8A and 8B, leading edge 74 of media sheet 72 has been urged into contact with initial nip 66. Initial de-skew rollers 64 are opposing media sheet 72. As media sheet 72 is still being urged in direction (C), a buckle 76 is formed allowing leading edge 74 to more fully engage initial nip 66. As can be seen from a comparison of FIGS. 7 and 8, the skew results in one corner of leading edge 74 reaching initial nip 66 first. The continued urging of media sheet in direction (C) coupled with the opposition of initial de-skew rollers 64 causes media sheet 72 to buckle and allows the other corner of leading edge 74 to be urged into contact with or toward the initial nip 66 helping to reduce or eliminate the skew.

Figure 9A:
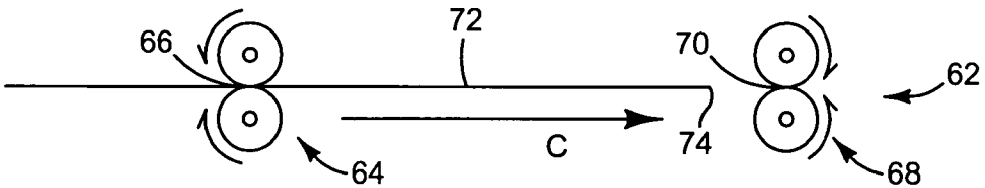
Figure 9B:
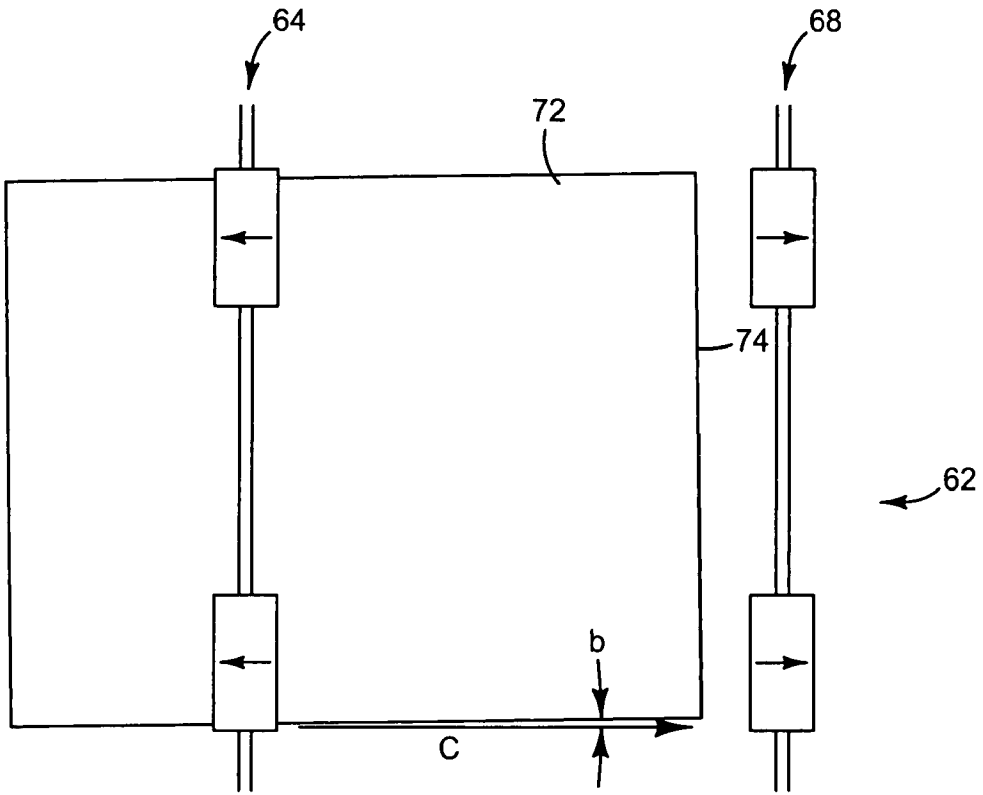

Moving to FIGS. 9A and 9B, initial de-skew rollers 64 are being rotated to pinch and urge media sheet in direction (C) toward subsequent de-skew rollers 68 such that leading edge 74 will eventually engage subsequent nip 70. Angle (b) represents the residual skew of media sheet 72. The subsequent de-skew rollers 68 are shown rotating in opposition to the direction (C) in which media sheet 72 is being urged.

Figure 10A:
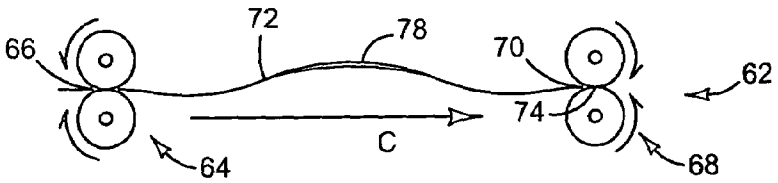
Figure 10B:
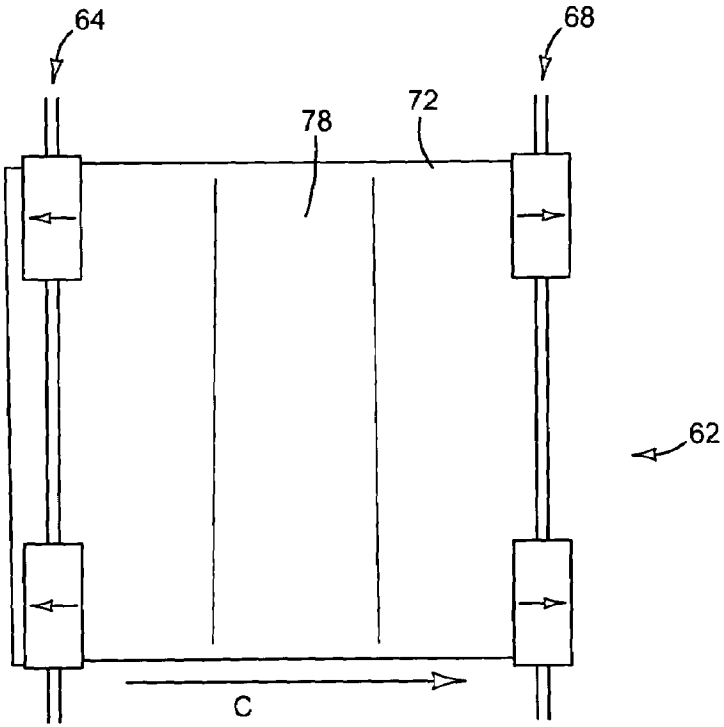

Moving on to FIGS. 10A and 10B, leading edge 74 of media sheet 72 has been urged into contact with subsequent nip 70. Subsequent de-skew rollers 62 are opposing media sheet 72. As media sheet 72 is still being urged in direction (C) by initial de-skew rollers 64, a buckle 78 is formed allowing leading edge 74 to more fully engage subsequent nip 70. As can be seen from a comparison of FIGS. 8 and 9, the residual skew results in one corner of leading edge 74 reaching subsequent nip 70 first. The continued urging of media sheet in direction (C) by initial de-skew rollers 64 coupled with the opposition of subsequent de-skew rollers 68 causes media sheet 72 to buckle and allows the other corner of leading edge 74 to be urged into contact with the subsequent nip 70 helping to reduce or eliminate the residual skew.

Figure 11A:
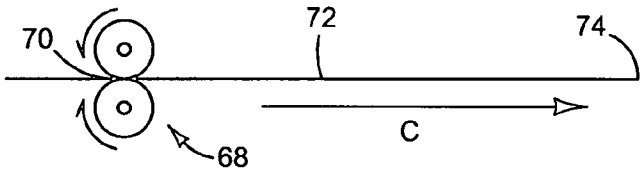
Figure 11A:
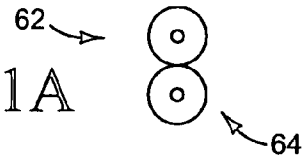
Figure 11B:
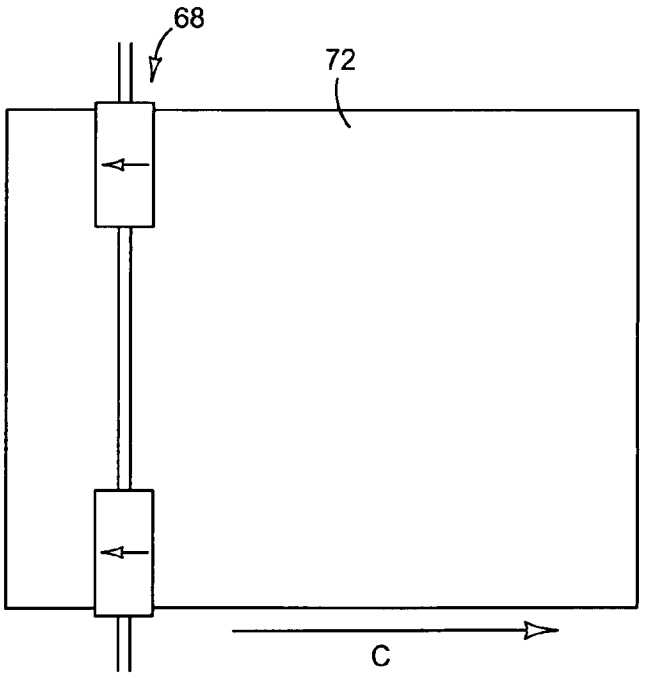
Figure 11B:
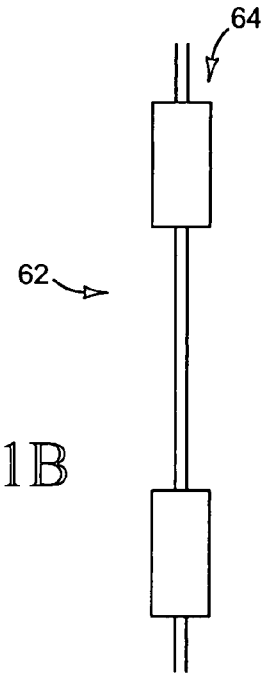

Referring now to FIGS. 11A and 11B, subsequent de-skew rollers 62 are being rotated to pinch and urge media sheet in direction (C). At this point, initial and subsequent de-skew rollers 64 and 62 have acted on media sheet 72 to remove or at least reduce the skew.

CONCLUSION

The image forming device 10 of FIG. 1 illustrates an exemplary environment in which embodiments may be implemented. Implementation, however, is not limited to image forming device 10. Embodiments may be implemented in any system or apparatus in which media sheets are transported from one place to another. The diagrams of FIGS. 2, 3A, and 3B show the architecture, functionality, and operation of various embodiments of the present invention. A number of the blocks are defined at least in part as programs. Each of those blocks may represent in whole or in part a module, segment, or portion of code that comprises one or more executable instructions to implement the specified logical function(s). Each block may also represent a circuit or a number of interconnected circuits to implement the specified logical function (s).

Also, the present invention can be embodied at least in part, in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, infrared, or semiconductor media. More specific examples of suitable computer-readable media include, but are not limited to, a portable magnetic computer diskette such as floppy diskettes, hard drives or a portable compact disc.

Although the flow diagrams of FIGS. 5-6 show specific orders of execution, the orders of execution may differ from that which is depicted. For example, the order of execution of two or more blocks may be scrambled relative to the order shown. Also, two or more blocks shown in succession may be executed concurrently or with partial concurrence. All such variations are within the scope of the present invention.

The exemplary implementation illustrated in FIGS. 7-11 is just that—an example implementation. There are a multitude of other interface configurations that will serve the same or similar purposes.

Embodiments of the present invention has been shown and described with reference to the foregoing exemplary embodiments. It is to be understood, however, that other forms, details and embodiments may be made without departing from the scope of the invention that is defined in the following claims.

What is claimed is:

1. A method, comprising:

urging a media sheet along a media path toward a first position and a second position, the second position being downstream from the first position along the media path;

as a leading edge of the media sheet reaches the first position, preventing the leading edge from passing the first position for an initial time period while the media sheet is being urged along the media path;

identifying a residual skew angle following the initial time period; and as the leading edge reaches the second position, preventing the leading edge from passing the second position for a subsequent time period while the media sheet is being urged along the media path;

wherein preventing comprises preventing the leading edge of the media sheet from passing along the media path for the subsequent time period while the media sheet is being urged along the media path passed the first position only if the residual skew angle exceeds a threshold value.

2. The method of claim 1, further comprising:

urging the media sheet along the media path passed the first position toward the second position after the initial time period; and urging the media sheet along the media path passed the second position after the subsequent time period.

3. The method of claim 1, wherein:

preventing the leading edge of the media sheet from passing the first position along the media path for the initial time period comprises causing an initial pair of rollers to oppose the leading edge of the media sheet for the initial time period as the leading edge is urged into contact with an initial nip defined by the initial pair of rollers; and preventing the leading edge of the media sheet from passing the second position along the media path for the subsequent time period comprises causing a subsequent pair of rollers to oppose the leading edge of the media sheet for the subsequent time period as the leading edge is urged into contact with a subsequent nip defined by the subsequent pair of rollers.

4. The method of claim 3, wherein:

causing the initial pair of rollers to oppose comprises rotating the initial pair of rollers for the initial time period to oppose the urging of the media sheet along the media path preventing the leading edge from passing through the initial nip; and causing the subsequent pair of rollers to oppose comprises rotating the subsequent pair of rollers for the subsequent time period to oppose the urging of the media sheet along the media path preventing the leading edge from passing through the subsequent nip.

5. The method of claim 4, further comprising:

rotating the initial pair of rollers to urge the media sheet along the media path toward the subsequent pair of rollers after the initial time period; and rotating the subsequent pair of rollers to urge the media sheet further along the media path after the subsequent time period.

6. The method of claim 3, wherein causing the subsequent pair of rollers to oppose comprises rotating the initial pair of rollers to urge the media sheet downstream along the media path while rotating the subsequent pair of rollers to oppose the urging of the media sheet along the media path.

7. The method of claim 3, wherein causing the subsequent pair of rollers to oppose comprises rotating the subsequent pair of rollers to urge the media sheet along the media path at slower velocity than at which the media sheet is being urged along the media path toward the subsequent rollers.

8. A method, comprising:

urging a media sheet from a source along a media path toward an initial pair of rollers:

affecting a rotation of the initial pair of rollers to oppose the urging of the media sheet for an initial time period as a leading edge of the media sheet is allowed to engage an initial nip defined by the initial pair of rollers;

rotating the initial pair rollers after the initial time period to urge the media sheet along the media path toward a subsequent pair of rollers;

identifying a residual skew angle as the initial pair of rollers are rotated to urge the media sheet along the media path and comparing the residual skew angle with a threshold value;

affecting a rotation of the subsequent pair of rollers to oppose the urging of the media sheet for a subsequent time period as the leading edge of the media sheet is allowed to engage a subsequent nip defined by the subsequent pair of rollers; and rotating the subsequent pair rollers after the subsequent time period to urge the media sheet further along the media path;

wherein affecting comprises affecting the rotation of the subsequent pair of rollers to oppose the urging of the media sheet only if the residual skew angle exceeds the threshold value.

9. The method of claim 8, wherein affecting the rotation of the initial and subsequent pairs of rollers comprises stopping or not rotating the initial and subsequent pairs of rollers.

10. The method of claim 8, wherein affecting the rotation of the initial and subsequent pairs of rollers comprises rotating the initial and subsequent pairs of rollers in directions selected to oppose the urging of the media sheet.

11. A multi-stage skew correction system, comprising:

an initial mechanism positioned along a media path at a first position;

a subsequent mechanism positioned along the media path at a second position downstream of the first position along the media path, the subsequent mechanism including one or more sensors positioned for use in identifying residual skew of the media sheet as the media sheet is urged passed the first position along the media path; and a controller operable to cause the initial mechanism to prevent a leading edge of a media sheet from passing along the media path for an initial time period as the media sheet is being urged along the media path toward the first position and to cause the subsequent mechanism to prevent the leading edge of the media sheet from passing along the media path for a subsequent time period as the media sheet is being urged along the media path passed the first position and toward the second position;

wherein the controller is operable to utilize the one or more sensors to identify a residual skew angle and to cause the subsequent mechanism to prevent the leading edge of the media sheet from passing along the media path for the subsequent time period as the media sheet is being urged along the media path only if the residual skew angle exceeds a threshold value.

12. The system of claim 11, wherein the controller is further operable to:

cause the initial mechanism to urge the media sheet along the media path passed the first position and toward the second position after the initial time period; and cause the subsequent mechanism to urge the media sheet along the media path passed the second position after the subsequent time period.

13. The system of claim 11, wherein the initial mechanism includes an initial pair of rollers defining an initial nip and the subsequent mechanism includes a subsequent pair of rollers defining a subsequent nip, wherein:

the controller is operable to cause the initial mechanism to prevent the leading edge of the media sheet by causing the initial pair of rollers to oppose the leading edge of the media sheet for the initial time period as the leading edge is urged into contact with the initial nip; and the controller is operable to cause the subsequent mechanism to prevent the leading edge of the media sheet by causing the subsequent pair of rollers to oppose the leading edge of the media sheet for the subsequent time period as the leading edge is urged into contact with the subsequent nip.

14. The system of claim 13, wherein:

the controller is operable to cause the initial pair of rollers to oppose the leading edge of the media sheet by causing a rotation of the initial pair of rollers for the initial time period to oppose the urging of the media sheet along the media path preventing the leading edge from passing through the initial nip; and the controller is operable to cause the subsequent pair of rollers to oppose the leading edge of the media sheet by causing a rotation of the subsequent pair of rollers for the subsequent time period to oppose the urging of the media sheet along the media path preventing the leading edge from passing through the subsequent nip.

15. The system of claim 14, wherein the controller is operable to:

cause a rotation of the initial pair of rollers to urge the media sheet along the media path toward the second position after the initial time period; and cause a rotation of the subsequent pair of rollers to urge the media sheet along the media path passed the second position after the subsequent time period.

16. The system of claim 13, wherein the controller is operable to cause the sub sequent pair of rollers to oppose the leading edge of the media sheet by causing a rotation the initial pair of rollers to urge the media sheet downstream along the media path and rotating the subsequent pair of rollers to oppose the urging of the media sheet along the media path.

17. The system of claim 13, wherein the controller is operable to cause the subsequent pair of rollers to oppose the leading edge of the media sheet by causing a rotation of the subsequent pair of rollers to urge the media sheet along the media path at slower velocity than at which the media sheet is being urged along the media path toward the second position.

* * * * *

UNITED STATES PATENT AND TRADEMARK OFFICE

CERTIFICATE OF CORRECTION

PATENT NO. : 7,637,500 B2
APPLICATION NO. : 11/391111
DATED : December 29, 2009
INVENTOR(S) : Wesley R. Schalk et al.

It is certified that error appears in the above-identified patent and that said Letters Patent is hereby corrected as shown below:

In column 8, line 60, in Claim 8, delete “rollers:” and insert -- rollers; --, therefor.

In column 10, line 41, in Claim 16, delete “sub sequent” and insert -- subsequent --, therefor.

In column 10, line 42, in Claim 16, delete “the” and insert -- of the --, therefor.

Signed and Sealed this
Fourth Day of January, 2011

David J. Kappos

David J. Kappos
*Director of the United States Patent and Trademark Office*